US010400405B2

(12) United States Patent
Herzog et al.

(10) Patent No.: US 10,400,405 B2
(45) Date of Patent: Sep. 3, 2019

(54) CLEARING VEHICLE WITH A COUPLEABLE SWEEPER-BLOWER ARRANGEMENT

(71) Applicant: Marcel Boschung AG, Payerne (CH)

(72) Inventors: Kurt Herzog, Kleinbösingen (CH); Kurt Wuillemin, Villars-sur-Glâne (CH)

(73) Assignee: Marcel Boschung AG, Payerne (CH)

( * ) Notice: Subject to any disclaimer, the term of this patent is extended or adjusted under 35 U.S.C. 154(b) by 194 days.

(21) Appl. No.: 15/674,718

(22) Filed: Aug. 11, 2017

(65) Prior Publication Data

US 2018/0051431 A1 Feb. 22, 2018

(30) Foreign Application Priority Data

Aug. 18, 2016 (EP) ..... 16001817

(51) Int. Cl.

*E01H 5/09* (2006.01)
*E01H 1/08* (2006.01)
*E01H 6/00* (2006.01)

(52) U.S. Cl.

CPC ..... *E01H 5/098* (2013.01); *E01H 1/0818* (2013.01); *E01H 5/092* (2013.01); *E01H 6/00* (2013.01)

(58) Field of Classification Search

CPC ..... E01H 5/098; E01H 5/092; E01H 6/00; E01H 1/0818

See application file for complete search history.

(56) References Cited

U.S. PATENT DOCUMENTS 3,007,191 A * 11/1961 Hermann ..... E01H 1/0872 15/340.3
4,685,228 A 8/1987 Gisler et al.
4,858,270 A * 8/1989 Boschung ..... E01H 1/0818 15/328
5,077,920 A 1/1992 Farrell
5,884,359 A * 3/1999 Libhart ..... E01H 1/0872 15/340.3

(Continued)

FOREIGN PATENT DOCUMENTS

DE 3924646 1/1991
EP 0189371 1/1985

(Continued)

OTHER PUBLICATIONS

European Search Report No. 160018172, dated Feb. 10, 2017.

*Primary Examiner* — Jamie L Mcgowan
(74) *Attorney, Agent, or Firm* — Cooper & Dunham LLP

(57) ABSTRACT

A clearing vehicle comprises a supporting frame (3) and a sweeper-blower arrangement (4), which is adjustably pivotable around a vertical axis (5) which runs through the clearing vehicle with respect to the supporting frame (3) and comprises a blow-air device (8). Furthermore, a blower (6) is arranged at the supporting frame (3), wherein blow-air is conducted from the blower (6) through the hollow body (7) to the blow-air device (8). The hollow body (7) and the blow-air device (8) are brought in blow-air connection by a first pivoting movement from a transport position to a working position. The blow-air connection between the hollow body (7) and the blow-air device (8) is removed by a second pivoting movement from the working position to the transport position.

14 Claims, 6 Drawing Sheets

(56) References Cited

U.S. PATENT DOCUMENTS

| | | | | |
|---|---|---|---|---|
| 6,618,897 | B2 * | 9/2003 | Lewis | A46B 13/001 15/319 |
| 2016/0201279 | A1 | 7/2016 | Wuillemin et al. | |

FOREIGN PATENT DOCUMENTS

| | | | | |
|---|---|---|---|---|
| EP | 3042996 | | 7/2016 | |
| EP | 3284866 | A1 * | 2/2018 | E01H 1/0818 |
| JP | 2005207151 | | 8/2005 | |

* cited by examiner

CLEARING VEHICLE WITH A COUPLEABLE SWEEPER-BLOWER ARRANGEMENT

CROSS REFERENCE TO RELATED APPLICATIONS

This application claims the priority of European patent application 16 001 817.2, filed Aug. 18, 2016, the disclosure of which is incorporated herein by reference in its entirety.

TECHNICAL FIELD

The invention relates to a clearing vehicle with a supporting frame and a sweeper-blower arrangement, which is adjustably pivotable around a vertical axis which runs through the clearing vehicle with respect to the supporting frame and comprises a blow-air device. Furthermore, the clearing vehicle has a blower arranged at the supporting frame and a hollow body for guiding the blow-air from the blower to the blow-air device. Furthermore, the invention relates to a method for operating a clearing vehicle.

BACKGROUND ART

From EP3042996, a snow clearing vehicle is known has a sweeping-roller brush and a sweeper-blower arrangement for removing snow by an air flow. The sweeper-blower arrangement has several blow-air openings for blowing simultaneously and with an identical effect. For a clearly better removal of the snow which is left behind by the plough or of the snow which is loosened from the sweeping-roller brush, a blow-air distribution which is along the sweeping-roller brush as uniform as possible is sought.

The sweeper-blower arrangement is adjustably pivotable around a vertical axis which runs through the clearing vehicle. It can be pivoted in different working positions or in a transport position.

Such snow clearing vehicles have proven their worth. They are applied in particular for the snow clearing on runways for airplanes where large volumes of snow have to be removed rapidly.

DISCLOSURE OF THE INVENTION

Therefore, the objective of the present invention is to create an improved clearing vehicle. In particular the sweeper-blower arrangement should be pivoted more easily.

This objective is solved according to the independent device claim.

According to this, the clearing vehicle, which is preferably a snow clearing vehicle, comprises a supporting frame and a sweeper-blower arrangement. The sweeper-blower arrangement is arranged adjustably pivotally around a vertical axis which runs through the clearing vehicle with respect to the supporting frame. Additionally, the sweeper-blower arrangement comprises a blow-air device.

Furthermore, the clearing vehicle comprises a blower arranged at the supporting frame for generating blow-air and a hollow body for guiding the blow-air from the blower to the blow-air device.

The sweeper-blower arrangement with the blow-air device is pivotable by a first pivoting movement to a working position and with a second pivoting movement to a transport position.

The pivoting to the transport position is particularly provided if the clearing vehicle should be moved over longer distances with increased speed without the sweeper-blower arrangement operating and also if the clearing vehicle is parked. It is pivoted to the working position if the sweeper-blower arrangement should be operated.

The hollow body and the blow-air device are adapted and arranged such that they can be brought to blow-air connection by the first pivoting movement and the blow-air connection is removed by the second pivoting movement.

This leads to the result that the hollow body and the blow-air device are not connected with each other for conducting blow-air in the transport position. But in the working position, the blow-air connection is guaranteed and the blow air can be guided from the hollow body to the blow-air device.

This has the advantage that the blow-air connection between the hollow body and the blow-air device can be established by the pivoting movement and it is not necessary to bring the hollow body or the blow-air device in position by hand in order to establish the blow-air connection, for example. Thereby, the driver of the clearing vehicle does not have to leave the vehicle for pivoting from the transport position to the working position in order to bring the hollow body and the blow-air device in blow-air connection.

Basically, the hollow body and the blow-air device could stay connected during the whole pivoting movement, i.e. also in the transport position, such that it is not necessary to establish or remove the blow-air connection. But this is hardly possible or at least only with difficulties due to the complex construction of the clearing vehicle, in particular of the support or the hollow body.

For this reason, it has been shown that it is advantageous to bring the hollow body and the blow-air device in blow-air connection by a first pivoting movement and to remove the blow-air connection by a second pivoting movement.

Furthermore, the clearing vehicle can have a coupling device for coupling the hollow body and the blow-air device.

The coupling device is any device which supports the connection between the hollow body and the blow-air device. For example, the coupling device holds together the hollow body and the blow-air device, or it holds both in position such that the blow-air connection remains, even if the vehicle is strongly shaken while driving.

Advantageously, the coupling device is adapted such that a contact face between the hollow body and the blow-air device is vertically arranged.

Advantageously, the hollow body comprises

- a first hollow body part, which is arranged at the blower and is not movable with respect to the supporting frame,
- a pivoting body, which is arranged at the hollow body part, and
- at least one further hollow body part, which is pivotally arranged at the pivoting body and pivots together with the blow-air device at least partly.

In a preferred embodiment, the coupling device is adapted such that the hollow body and the blow-air connection are mutually coupleable by the coupling device with power of the first pivoting movement, and mutually uncoupleable with power of the second pivoting movement, i.e. removed from the coupling.

This has the advantage that the coupling can be established only by the power of the pivoting movement. Therefore, no more manipulations are necessary, for example by hand or by an additional actuator to actuate the coupling. However, such manipulations are still possible if the coupling resulted by the pivoting movement should be strengthened by an additional coupling.

With advantage, the coupling device is arranged at the supporting frame. The blow-air device is guided in its pivoting movements by the coupling device at least partly, in particular fully, and a coupleable end of the hollow body is arranged at the coupling device.

Since the coupling device is arranged at the supporting frame, it does not pivot together with the pivoting movement of the blow-air device. Therefore, the blow-air device pivots along the coupling device which guides the pivoting movement.

The coupling device does not necessarily have to guide the blow-air device over the whole pivoting movement. Advantageously, the pivoting movement is guided in the working positions such that the hollow body and the blow-air device are precisely oriented to each other for conducting the blow-air.

Advantageously, the coupling device has a guide rail, along which the blow-air device is movably arranged.

Furthermore, the coupling device can be arranged at the supporting frame pivotally via a rotatable arm and pivotally together with the blow-air device in a coupled state, such that the blow-air device is guided by the rotatable arm and the coupling arrangement.

In a particular embodiment, at least two hollow body parts are arranged not pivotally with respect to the supporting frame. The blow-air device is in blow-air connection with one each of the at least two non pivotable hollow body parts depending on the adjusted working position.

In other words, the blow-air connection is connected with a first hollow body part for the operation in a first working position and with a second hollow body part for the operation in a second working position. Therefore, the first and the second hollow body part have different outlets, by means of which the blow-air device is in blow-air connection.

Both hollow body parts can be guided together and be connected with the blower via a common section of the hollow body. I.e. not every single hollow body part has to be connected by itself with the blower, but a single hollow body, away from the blower, can split up in two hollow body parts, for example.

Such an arrangement of the hollow body has the advantage that it can be constructed in a very simple way because the hollow body parts have to be arranged at the supporting frame statically and not pivotally.

Advantageously, the blow-air device is in blow-air connection with a first hollow body part if the sweeper-blower arrangement is pivoted such that it is cleared to a first clearing vehicle side, in particular to the right in driving direction, and is in blow-air connection with a second hollow body part if the sweeper-blower arrangement is pivoted such that it is cleared to a second clearing vehicle side, in particular to the left in driving direction.

Alternatively to a static arrangement of the hollow body, it can be provided that the hollow body is pivotally arranged at the supporting frame. The coupling device is adapted such that the hollow body is coupled pivotally together with the pivoting movements of the blow-air device in a synchronous way.

In particular, the synchronous pivoting movement extends over an angle section of at least 45°, in particular of at least 60°, in particular of at least 90°.

On the one hand, a pivotally arranged hollow body is more costly and more complex to construct compared to a statically arranged hollow body, but on the other hand it can be moved into an arbitrary number of positions in the pivoting section. Thereby, the blow-air device can not only be brought in blow-air connection at these position where static hollow body parts are arranged.

Advantageously, the coupling device is adapted such that the blow-air device is guided in its pivoting movements over an angle section of at least 60°, in particular of at least 75°, in particular of at least 90°, in particular of at least 90°, in particular of at least 135°, in particular wherein the blow-air device is guided in its pivoting movements over an angle section of maximally 150°, in particular maximally 135°, in particular maximally 110°, in particular maximally 90°, in particular maximally 60°.

Furthermore, the clearing device has a pressing device for pressing the at least one blow-air device against the coupling device and/or the hollow body.

If the hollow body and the blow-air device are not coupled via a stiff connection in a working position, it has the advantage that the hollow body and the blow-air device reliably remain in blow-air connection, even if the vehicle is strongly shaken by irregularities of the route.

In a preferred embodiment the sweeper-blower arrangement is arranged pivotally over an angle of at least 90°, in particular of at least 110°, in particular of at least 130°, in particular of at least 135°, in particular wherein the sweeper-blower arrangement is in the transport position at an angle of 0°, and in the working position at an angle between 30°, in particular 45°, and 135°, in particular 120°.

In known manner, the clearing vehicle can be a vehicle with an own traction drive and in particular a plough at the front. Alternatively the clearing vehicle can be a pullable vehicle without an own traction drive such that it can be carried as a trailer behind a vehicle, in particular a snow-plough.

Furthermore, the objective of the present invention is to reach an improved clearing, in particular snow clearing, with a clearing vehicle.

The objective is solved with a method according to the independent method claim.

According to this, the clearing vehicle has a sweeper-blower arrangement which comprises at least one blow-air device.

The sweeper-blower arrangement is pivoted from a transport position in a first working position by a first pivoting movement such that the at least one blow-air device is brought in blow-air connection with at least one hollow body. The sweeper-blower arrangement is pivoted with a second pivoting movement from a working position in a transport position such that the blow-air connection between the at least one blow-air device and the at least one hollow body is removed.

The same advantages are reached as already described for the independent device claim.

BRIEF DESCRIPTION OF THE DRAWINGS

Further embodiments, advantages and applications of the invention arise from the dependent claims and the following description according to the figures. Thereby show:

MODES FOR CARRYING OUT THE INVENTION

Figure 1:
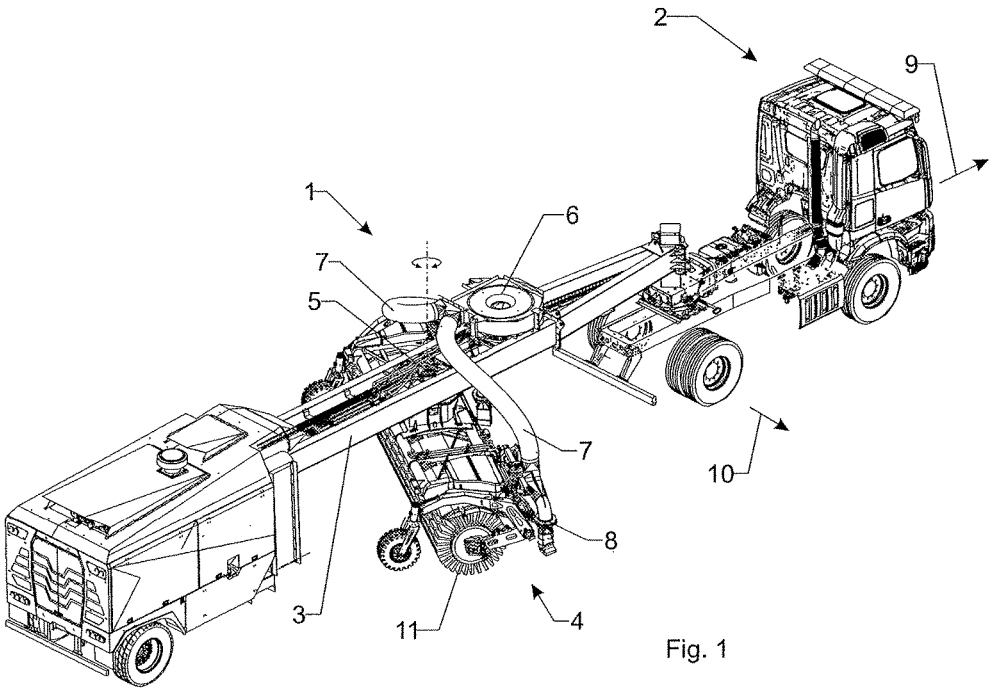
FIG. 1 a clearing vehicle (prior art)

In FIG. 1 a clearing vehicle for clearing snow is shown, as it is known to a person skilled in the art from prior art and is sometimes called a sweeper-blower vehicle as well. This has a trailer 1 and towing vehicle 2. The clearing vehicle rests on the ground, on which the snow to be cleared is arranged and which is a runway of an airport, for example. Such a vehicle includes the drives which are usually present on clearing vehicles, and which are not further described here. The clearing vehicle has a snow plough (not shown) at the front which is not further described here because it is known to the person skilled in the art of snow clearing vehicles. The clearing vehicle has a supporting frame 3 and a sweeper-blower arrangement 4. The sweeper-blower arrangement 4 is arranged pivotally around vertical axis 5 which runs through the clearing vehicle.

The ground should be cleared from the snow by the clearing vehicle as cleanly as possible. The snow, which is not cleared properly from the ground by the snow plough arranged at the front side of the clearing vehicle, is then removed from the ground by the sweeper-blower arrangement 4.

For this, the sweeper-blower arrangement 4 has a sweeping-roller brush 11, by means of which the snow can be removed or cleaned and swirled from the ground, and a blow-air device 8, by means of which the swirled snow is blown to the side. A blower 6 is arranged at the supporting frame 3 to supply blow-air to the blow-air device 8, which conducts blow-air to the blow-air device 8 via two parts of a hollow body 7.

In FIG. 1, the sweeper-blower arrangement 8 is pivoted in a working position such that the snow is cleared and blown in driving direction (arrow 9) to the right (arrow 10). The two hollow body parts of the hollow body 7 are coupled with the blow-air device 8 in order to conduct the blow-air generated by the blower to the blow-air device 8.

The sweeper-blower arrangement 4 is pivotable in a transport position, in which the sweeping-roller brush 11 is arranged with its pivoting axis basically lying in the longitudinal direction of the clearing vehicle. For example, the transport position is useful for the transport over long routes, in particular over small streets, or for a space-saving parking of the clearing vehicle in a garage.

With a clearing vehicle as shown in FIG. 1 and known from the state of the art, the hollow body parts of the hollow body 7 have to be uncoupled in order to pivot the sweeper-blower arrangement 4 to the transport position.

In the further figures, three different embodiments of an improved clearing vehicle are shown, at which the sweeper-blower arrangement 4 can be pivoted as easily as possible between the transport position and the working position.

In the FIG. 2 to 5, the first embodiment of the clearing vehicle is shown, wherein it has static hollow body parts of the hollow body 7, i.e. the hollow body parts or the hollow body 7 do not pivot together with the pivoting movement of the sweeper-blower arrangement. In the FIG. 6 to 8, a second embodiment of the clearing vehicle has hollow body parts of the hollow body 7, which pivot together with the pivoting movement of the sweeper-blower arrangement 4. In FIG. 9, a further embodiment is shown, where the hollow body parts of the hollow body 7 are partly pivoted together with the pivoting movement of the sweeper-blower arrangement 4 without twisting.

Figure 2:
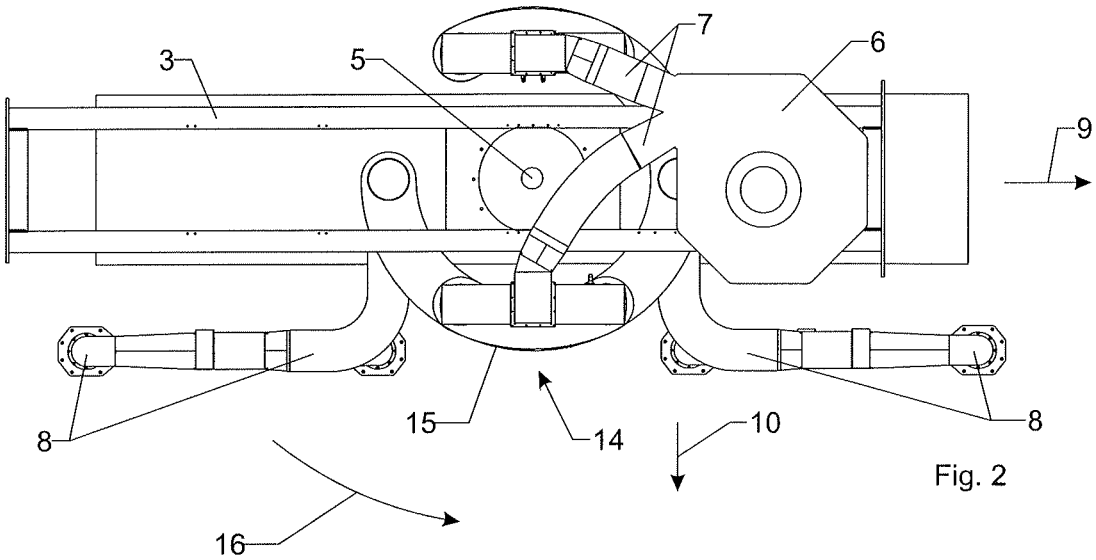
FIG. 2 a sweeper-blower arrangement with a non pivotable hollow body in a transport position in a top view, FIG. 3 a sweeper-blower arrangement with a non pivotable hollow body in a transport position in a side view, FIG. 4 a sweeper-blower arrangement with a non pivotable hollow body in a working position in a top view, FIG. 5 a sweeper-blower arrangement with a non pivotable hollow body in a working position in a side view, FIG. 6 a sweeper-blower arrangement with a pivotable hollow body in a transport position in a side view, FIG. 7 a sweeper-blower arrangement with a pivotable hollow body in a working position in a top view, FIG. 8 a sweeper-blower arrangement with a pivotable hollow body in a working position in a side view, and FIG. 9 a sweeper-blower arrangement with a partly pivotable hollow body and a vertical coupling face in a working position.
Figure 3:
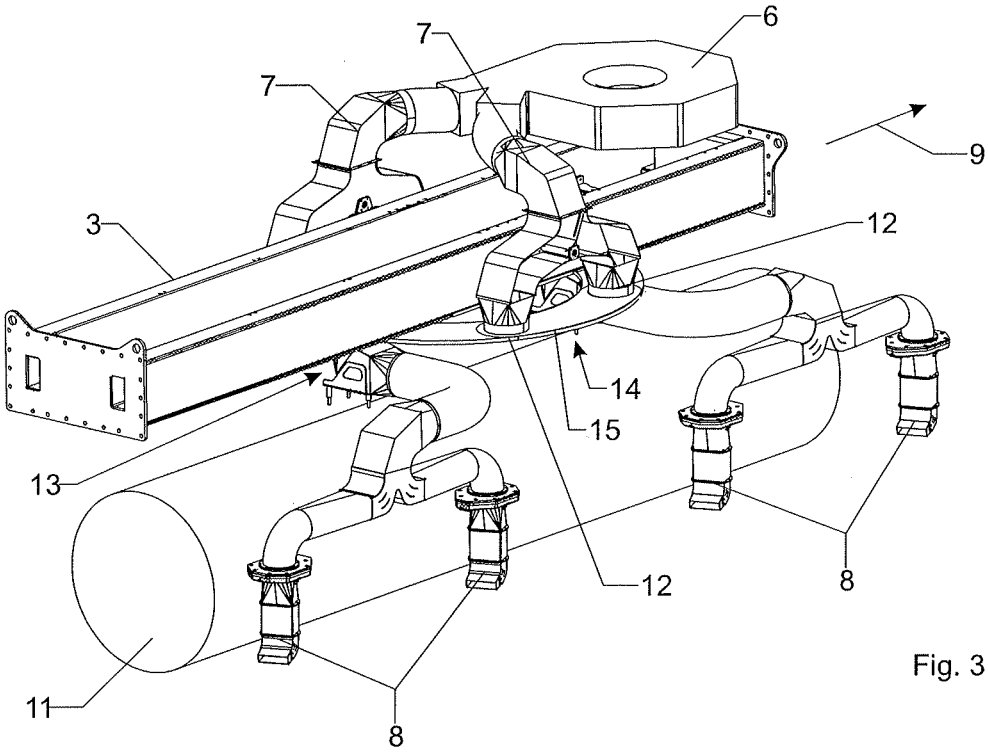

In the FIGS. 2 and 3, the clearing vehicle of the first embodiment is shown in the transport position. In the transport position, the sweeper-blower arrangement 4 with the sweeping-roller brush 11 and the blow-air device 8 are arranged parallel to the driving direction 9, or the longitudinal axis of the sweeping-roller brush basically lies coaxial with respect to the longitudinal axis of the supporting frame 3, such that the clearing vehicle is as small as possible in its lateral expansion.

In the transport position, the hollow body parts of the hollow body 7 and the blow-air devices 8 are not in blow-air connection. The hollow body outlets 12, i.e. the coupleable ends of the hollow body parts of the hollow body 7, are not connected with the inlets of the blow air device, i.e. with the coupleable ends of the blow-air device 8.

Two hollow body parts of the hollow body 7 lead away from the blower 6 or the hollow body 7 splits up in two separate hollow body parts or hollow body strands such that overall four hollow body outlets 12 are provided in order to supply the blow-air device. In driving direction 9, two hollow body outlets 12 are arranged on the left and two hollow body outlets are arranged on the right of the supporting frame 3. In this embodiment, all parts of the hollow body 7 are statically arranged with respect to the supporting frame 3 and are not pivoted together with the sweeper-blower arrangement around the vertical axis 5.

Furthermore, the clearing vehicle has a coupling device 14, which supports the blow-air connection between hollow body 7 and blow-air device 8. In the present embodiment, the coupling device 14 has a guide rail 15, which guides the blow-air devices 8 and the inlets 13 of the blow air devices in its movements such that these are precisely in blow-air connection with the hollow body parts of the hollow body 7 when reaching the working positions.

Figure 4:
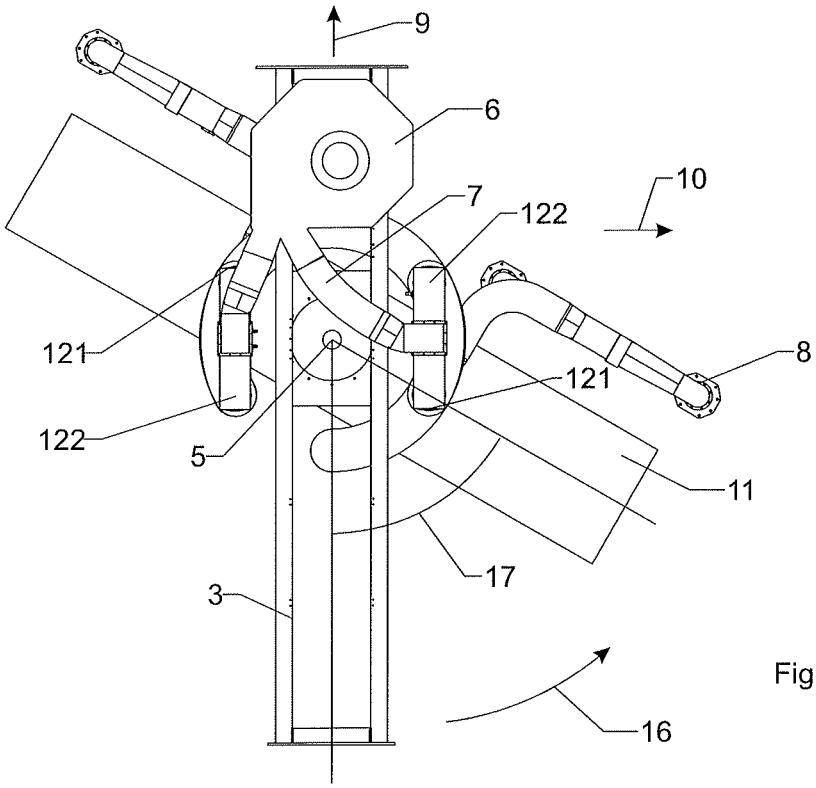
Figure 5:
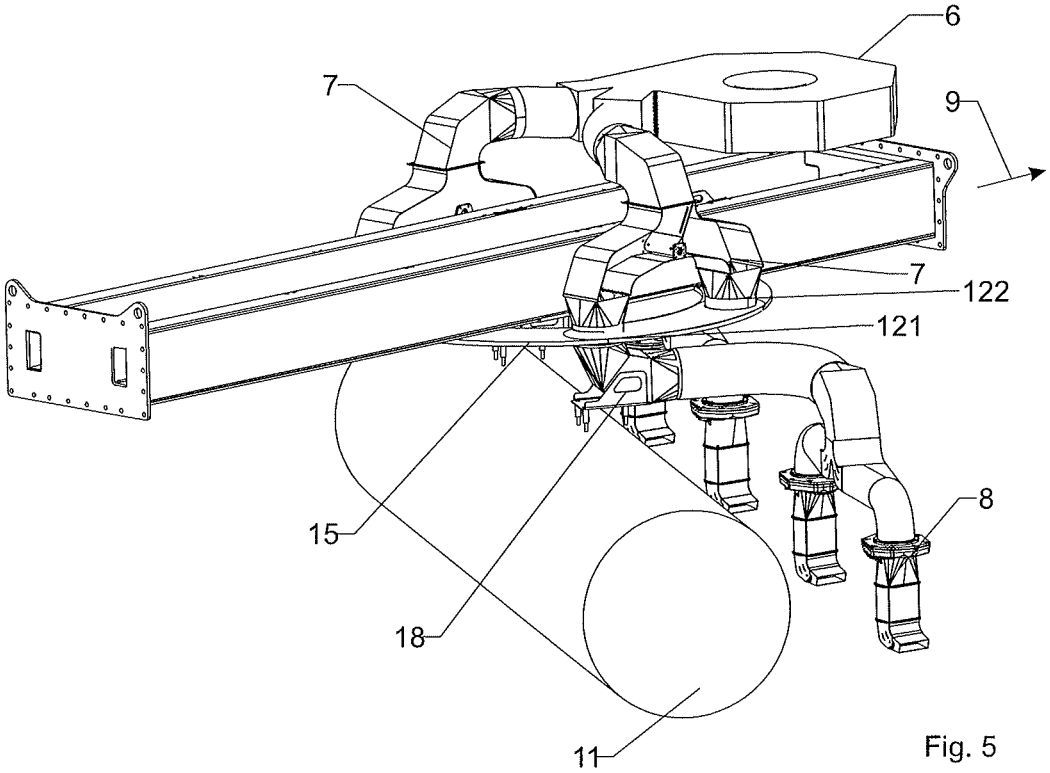

The sweeper-blower arrangement 4 can be pivoted (arrow 16) from the transport position to the first working position around the vertical axis 5. In FIGS. 4 and 5, the clearing vehicle is shown in its first working position. Like in FIG. 1, the snow is cleared in driving direction (arrow 9) to the right (arrow 10). For this, the sweeper-blower arrangement 4 is pivoted from the transport position over an angle 17 of 45° in anticlock-wise direction (arrow 16). As shown in FIG. 5, the blow-air device 8 is in blow-air connection with the hollow body 7 in the first working position. The blow-air device 8 was precisely guided to a first hollow body outlet 121 by the guide rail 15. On the side opposite to the supporting frame 3, the blow air device 8 is also in blow-air connection with the hollow body 7 at a first hollow body outlet 121.

If the sweeper-blower arrangement would be pivoted by further 90° in anticlockwise direction, then the blow air devices 8 and the hollow body 7 are in blow-air connection at the second hollow body outlets 122 in a second working position such that snow is blown to the left. In this case, the blow-air device 8 would be pivoted by 135° altogether in anticlockwise direction starting from the transport position. The blow-air device 8 moves along the guide rail 15 at the pivoting movement from the first working position to the second working position, wherein the blow-air connection with the first hollow body outlet 121 is removed and a blow-air connection with the second hollow body outlet 122 is established.

Furthermore, the clearing vehicle has a pressing device 18, by means of which the blow-air device 8 is pressed against the guide rail 15 or the hollow body 7.

Figure 6:
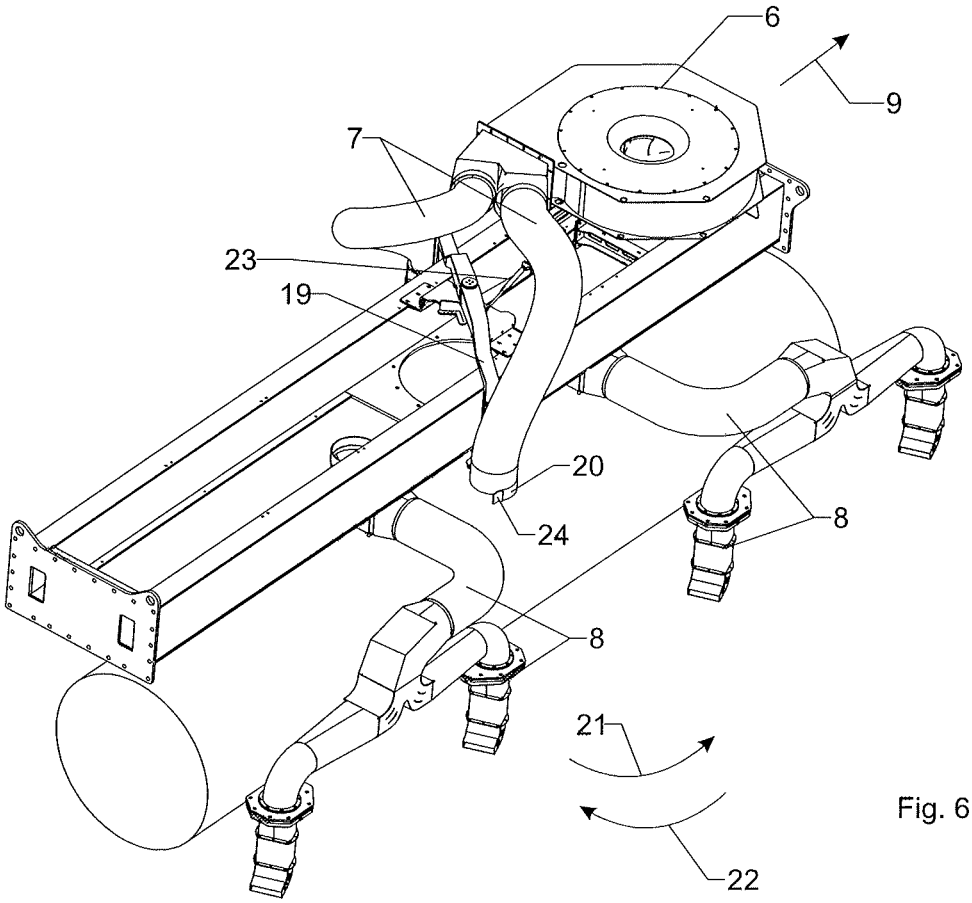

Starting with FIG. 6, an alternative embodiment of the clearing vehicle is shown. This has a hollow body 7 with hollow body parts, which are not statically arranged at the supporting frame 3 anymore, but can be pivoted together with the pivoting movement of the sweeper-blower arrangement at least partly.

In FIG. 6 the clearing vehicle is shown like in FIGS. 2 and 3 in the transport position. The blow-air device 8 and the hollow body parts of the hollow body 7 are not in blow-air connection. The hollow body 7 is kept in position via a rotatable arm 19.

The rotatable arm 19 has at its outer ends each a carrier dog 20 with a catching device 24. During the pivoting movement of the sweeper-blower arrangement from the transport position to the first working position, the catching device 24 catches the blow-air device such that the hollow body 7 and the blow-air device 8 are brought in blow-air connection.

Figure 7:
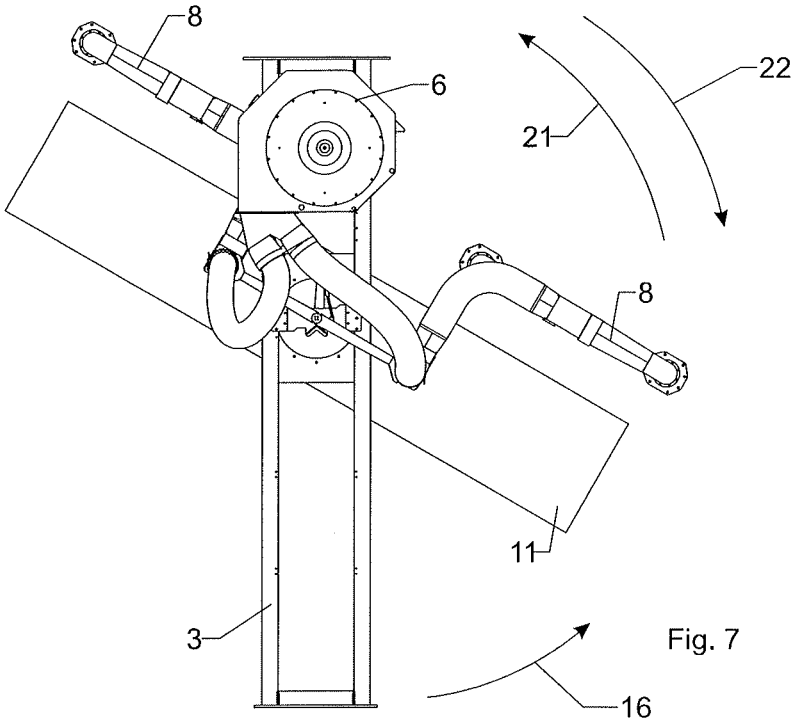
Figure 8:
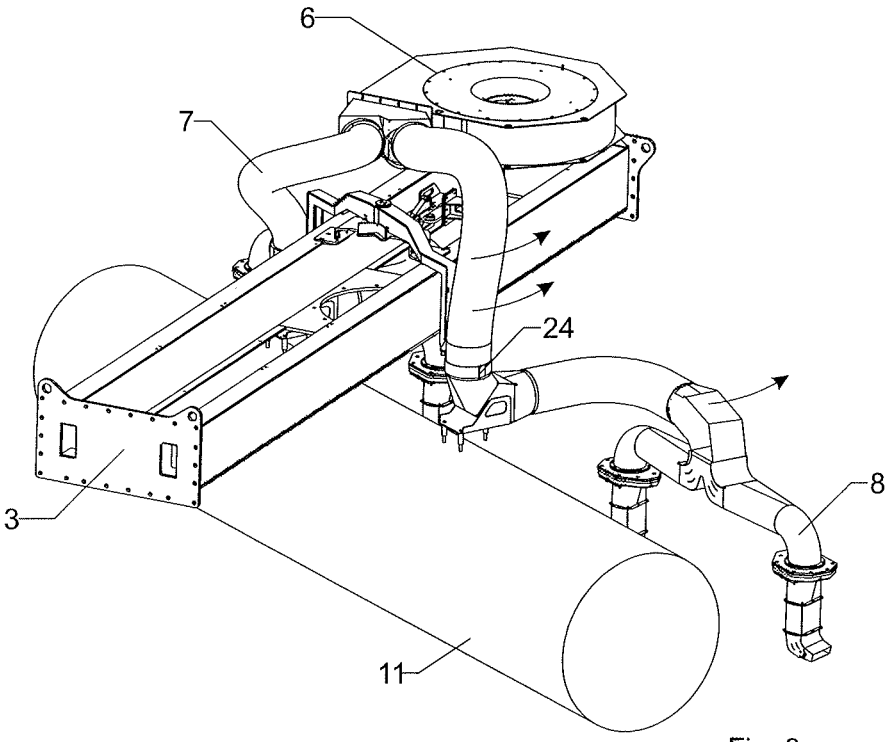
Figure 9:
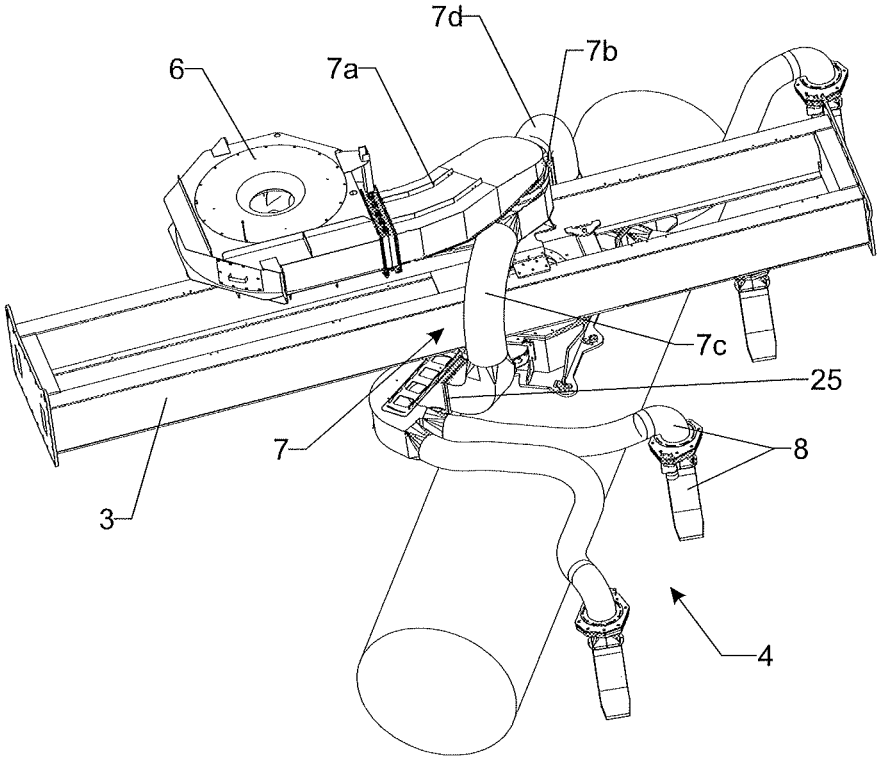

Starting from the first working position, which is shown by FIGS. 7 and 8, the sweeper-blower arrangement can be pivoted again over further 90° in anti-clockwise direction to a second working position. The carrier dog 20 transfers the power of the pivoting movement of the sweeper-blower arrangement in a first direction (arrow direction 21) to the hollow body parts of the hollow body 7 such that the hollow body parts synchronically pivot together with the blow-air device 8.

A resetting-device 23 is tensioned by the pivoting movement to the first direction (arrow direction 21). This moves the hollow body 7 and its parts in a second direction (arrow direction 22), which is opposite to the first direction as soon as the sweeping-blower arrangement is pivoted back in arrow direction 22. The hollow body 7 is formed from flexible tubes such that the hollow body 7 can synchronically pivot.

The advantage of a flexible hollow body 7 is that not only two working position are possible like in the first embodiment, but that the sweeper-blower arrangement can be pivoted in any angle between the first working position and the second working position.

In FIG. 9, a further embodiment is shown. This is very similar to the embodiment according to FIGS. 6 to 8. The clearing vehicle has a hollow body 7 with hollow body parts, which are partly arranged not statically at the supporting frame 3 and at least partly pivot together with the pivoting movement of the sweeper-blower arrangement.

The blower 6 is arranged at the supporting frame 3. A first hollow body part 7*a* leads from this to a pivoting body 7*b*, which can pivot with respect to the first hollow body part 7*a*. Two further hollow body parts 7*c* and 7*d* are arranged at the pivoting body 7*b*. The blower 6 and the first hollow body part 7*a* are fixedly arranged at the supporting frame 3 and do not move with respect to the supporting frame 3. The two further hollow body parts 7*c* and 7*d* are arranged at the pivotable pivoting body 7*b* and can completely pivot together with the sweeper-blower arrangement 4.

In contrast to the embodiment according to the FIG. 6 to 8, the hollow body parts do not twist. While the hollow body 7 is fixedly arranged at one end at the blower 6 and at the other end pivots together with the sweeper-blower arrangement 4 at the embodiment according to the FIG. 6 to 8, the two further hollow body parts 7*c* and 7*d* of the embodiment according to FIG. 9 pivot at both ends with the sweeper-blower arrangement 4. The hollow body parts according to this variant are only slightly mechanically stressed because they do not twist.

Furthermore, at the embodiment according to FIG. 9, the contact face 25 between the hollow body, i.e. the two further hollow body parts 7*c* and 7*d*, and the blow-air device 8 is arranged vertically and not horizontally like in the first two embodiments. Like at the other embodiments, the blow-air connection is established by the pivoting movement to the working position at the contact face and is removed by the pivoting movement to the transport position. While preferred embodiments of the invention have been described in this application, it is clearly noted that the invention is not restricted to them and may be carried out in other ways within the scope of the now following claims.

The invention claimed is:

1. A clearing vehicle, in particular a snow-clearing vehicle, comprising:

a supporting frame, a sweeper-blower arrangement, which is adjustably pivotable around a vertical axis which runs through the clearing vehicle with respect to the supporting frame and comprises a blow-air device, a blower arranged at the supporting frame for generating blow-air, a hollow body for guiding the blow-air from the blower to the blow-air device, wherein the sweeper-blower arrangement with the blow-air device is pivotable by a first pivoting movement in a working position and by a second pivoting movement in a transport position, characterized in that the hollow body and the blow-air device are adapted and arranged such that they are able to be brought into blow-air connection by the first pivoting movement, and the blow-air connection is removed by the second pivoting movement.

2. A clearing vehicle according to claim 1, wherein it has a coupling device for coupling the hollow body and the blow-air device.

3. A clearing vehicle according to claim 2, wherein the coupling device is adapted such that the hollow body and the blow-air device are mutually coupleable with power of the first pivoting movement by the coupling device, and are mutually uncoupleable with power of the second pivoting movement.

4. A clearing vehicle according to claim 2, wherein the coupling device is arranged at the supporting frame, and the blow-air device is guided in its pivoting movements by the coupling device at least partly, in particular fully, and wherein a coupling end of the hollow body is arranged at the coupling device.

5. A clearing vehicle according to claim 4, wherein the coupling device has a guide rail, along which the blow-air device is movably arranged, and/or the coupling device is pivotally arranged at the supporting frame and arranged pivotally together with the blow-air device in a coupled state via a rotatable arm (19), such that the blow-air device is guided by the rotatable arm and by the coupling device.

6. A clearing vehicle according to claim 1, wherein at least two hollow body parts of the hollow body are provided which are not pivotally arranged with respect to the supporting frame, wherein the blow-air device is in blow-air connection with one of the at least two non pivotable hollow body parts of the hollow body each depending on the working position.

7. A clearing vehicle according to claim 1, wherein the blow-air device is in blow-air connection with a first hollow body part of the hollow body if the sweeper-blower arrangement is pivoted such that it is cleared to a first clearing vehicle side, in particular to the right in driving direction, is in blow-air connection with a second hollow body part of the hollow body if the sweeper-blower arrangement is pivoted such that it is cleared to a second clearing vehicle side, in particular to the left in driving direction.

8. A clearing vehicle according to claim 2, wherein the coupling device is adapted such that the hollow body is coupled at least partly pivotally together with the pivoting movements of the blow-air device in a synchronous way, in particular over an angle section of at least 45°, in particular of at least 60°, in particular of at least 90°.

9. A clearing vehicle according to claim 2, wherein the coupling device is adapted such that the blow-air device is guided in its pivoting movements over an angle section of at least 60°, in particular of at least 75°, in particular of at least 90°, in particular of at least 135°, in particular wherein the blow-air device is guided in its pivoting movements over an angle section of maximally 150°, in particular maximally 135°, in particular maximally 110°, in particular maximally 90°, in particular maximally 60°.

10. A clearing vehicle according to claim 1, wherein it has a pressing device for pressing the at least one blow-air device against the coupling device and/or the hollow body.

11. A method for operating a clearing vehicle, wherein the clearing vehicle has a sweeper-blower arrangement with a blow-air device , characterized in that the sweeper-blower arrangement is pivoted by a first pivoting movement from a transport position to a first working position, such that the blow-air device is brought in blow-air connection with a hollow body, which conducts blow-air from a blower to the blow-air device during a blow operation, is brought in blow-air connection with a hollow body, is pivoted by a second pivoting movement from a working position to a transport position, such that the blow-air connection between the blow-air device and the at least one hollow body is removed.

12. A method according to claim 11, wherein the sweeper-blower arrangement is pivoted by a first pivoting movement from a transport position to a first working position, such that the blow-air device is coupled with a hollow body, which conducts blow-air of at least one blower to the blow-air device during a blow-air operation, with power of the first pivoting movement, is pivoted by a second pivoting movement from a working position to a transport position, such that the blow-air device is uncoupled from the hollow body with power of the second pivoting movement.

13. A method according to claim 11, wherein it is pivoted from a first working position to a second working position, such that the blow-air device and the hollow body pivot together synchronically and coupled, or that the blow-air device is uncoupled from a first hollow body part of the hollow body by the power of this pivoting movement, and is coupled with a second hollow body part of the hollow body by the power of this pivoting movement.

14. A method according to claim 13, wherein it is pivoted from the first working position to the second working position by a rotation over an angle of at least 30°, in particular of at least 60°, in particular of at least 75°, in particular of at least 90°, maximally 120°, in particular of maximally 105°, in particular of maximally 90°, in particular of maximally 60°.

* * * * *